US005120069A

United States Patent [19]

Shaw

[11] Patent Number: 5,120,069

[45] Date of Patent: Jun. 9, 1992

[54] BINGO WORKSTATION

[76] Inventor: Nathan C. Shaw, 1246 Pecos St., Redlands, Calif. 92374

[21] Appl. No.: 783,523

[22] Filed: Oct. 28, 1991

[51] Int. Cl.[5] ..... A63F 3/06; B65D 85/20

[52] U.S. Cl. ..... 273/309; 273/148 A; 273/269; 273/237; 190/11; 206/315.1; 206/579

[58] Field of Search ..... 273/269, 148 A, 148 R, 273/309, 237, 285, 287, 150; 190/10, 11; 206/315.1, 579

[56] References Cited

U.S. PATENT DOCUMENTS

| | | | |
|---|---|---|---|
| 2,522,322 | 9/1950 | Wallace | 190/11 |
| 3,802,708 | 4/1974 | Libert | 273/237 |
| 4,502,658 | 3/1985 | Wirt et al. | 273/285 |
| 4,544,158 | 10/1985 | Kilmonis | 273/150 |
| 4,630,830 | 12/1986 | Gadd | 273/269 |
| 4,761,008 | 8/1988 | Huggins | 273/148 R |
| 4,948,139 | 8/1990 | Heeszel | 273/148 A |
| 5,028,048 | 7/1991 | Watson et al. | 273/148 A |
| 5,054,783 | 10/1991 | Hull et al. | 273/148 A |

*Primary Examiner*—Benjamin Layno
*Attorney, Agent, or Firm*—Leon Gilden

[57] ABSTRACT

A carrying case is opened to arrange in a planar relationship, the housing floor of each mirror image housing. The structure includes cooperative handle retractably mounted with each rear end wall of the first and second housing, with elastomeric bands mounted to exterior surfaces of the floors of the first and second housings for securement of bingo card members therewithin. Spaced chambers are formed adjacent upper terminal ends of the forward end wall to accommodate bingo components, such as bingo chips, pencils, and the like. A modification of the invention includes each floor formed with an underlying illumination member positioned longitudinally of and coextensively with a translucent sheet coextensive with an overlying transparent sheet, wherein a bingo card member is positioned between the translucent and transparent sheets for mounting and positioning in play of a bingo game.

6 Claims, 4 Drawing Sheets

28
22
13
20
11
28
17
29
18
26
23
12
30
29
15
20
32
16
27
31
55
54
54a
33
21
17
55
53a
19
14
57
53
34
24
56
21
35
25

19
18
27
37
14
51
34
35

BINGO WORKSTATION

BACKGROUND OF THE INVENTION

1. Field of the Invention

The field of invention relates to bingo apparatus, and more particularly pertains to a new and improved bingo workstation wherein the same is arranged for providing a comprehensive workstation for use in a bingo playing procedure.

2. Description of the Prior Art

Bingo apparatus of various types have been utilized to accommodate bingo playing of contemporary popularity. Such apparatus is exemplified in U.S. Pat. No. 4,544,158 to Kilmonis setting forth a game carrier and board arranged to permanently hold game cards under a transparent sheet.

U.S. Pat. No. 4,948,139 to Heeszel sets forth a bingo game box for supporting various components of a bingo playing game.

U.S. Pat. No. 4,538,861 to Hughes, Jr. sets forth a portable desk providing various compartments for support of components within.

U.S. Pat. No. 4,291,882 to Del Monte wherein a bingo card holder is arranged for holding a bingo card with a forward compartment positioned for supporting various bingo playing components therewithin.

As such, it may be appreciated that there continues to be a need for a new and improved bingo workstation as set forth by the instant invention which addresses both the problems of ease of use as well effectiveness in construction and in this respect, the present invention substantially fulfills this need.

SUMMARY OF THE INVENTION

In view of the foregoing disadvantages inherent in the known types of bingo apparatus now present in the prior art, the present invention provides a bingo workstation wherein the same is arranged for supporting and holding various components in a bingo playing game arranged for ease of portability and storage during periods of non-use. As such, the general purpose of the present invention, which will be described subsequently in greater detail, is to provide a new and improved bingo workstation which has all the advantages of the prior art bingo apparatus and none of the disadvantages.

To attain this, the present invention provides a carrying case opened to arrange in a planar relationship the housing floor of each mirror image housing. The structure includes cooperative handle retractably mounted with each rear end wall of the first and second housing, with elastomeric bands mounted to exterior surfaces of the floors of the first and second housing for securement of bingo card members therewithin. Spaced chambers are formed adjacent upper terminal ends of the forward end wall to accommodate bingo components, such as bingo chips, pencils, and the like. A modification of the invention includes each floor formed with an underlying illumination member positioned longitudinally of and coextensively with a translucent sheet coextensive with an overlying transparent sheet, wherein a bingo card member is positioned between the translucent and transparent sheets for mounting and positioning in play of a bingo game.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bingo workstation which has all the advantages of the prior art bingo apparatus and none of the disadvantages.

It is another object of the present invention to provide a new and improved bingo workstation which may be easily and efficiently manufactured and marketed.

It is a further object of the present invention to provide a new and improved bingo workstation which is of a durable and reliable construction.

An even further object of the present invention is to provide a new and improved bingo workstation which is susceptible of a low cost of manufacture with regard to both materials and labor, and which accordingly is then susceptible of low prices of sale to the consuming public, thereby making such bingo workstations economically available to the buying public.

Still yet another object of the present invention is to provide a new and improved bingo workstation which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
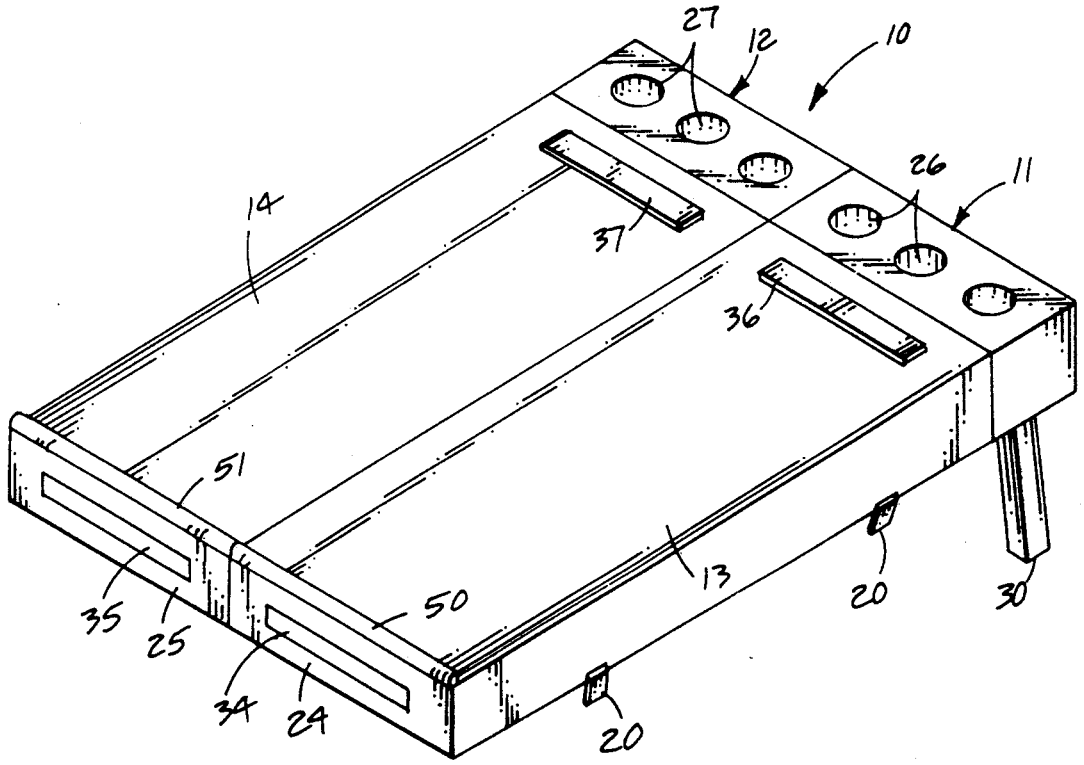
FIG. 1 is an isometric illustration of the instant invention.

With reference now to the drawings, and in particular to FIGS. 1 to 7 thereof, a new and improved bingo workstation embodying the principles and concepts of the present invention and generally designated by the reference numerals 10, 10*a*, and 10*b* will be described.

Figure 2:
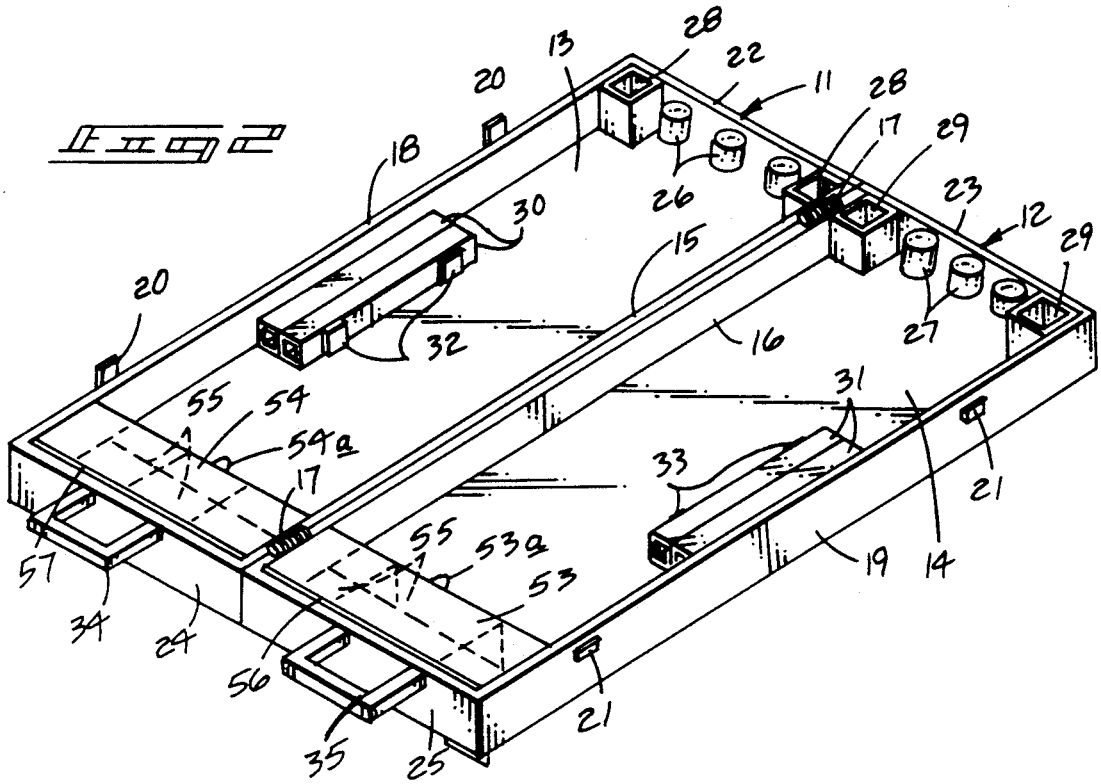
FIG. 2 is an isometric illustration of the invention in an opened second configuration.
Figure 3:
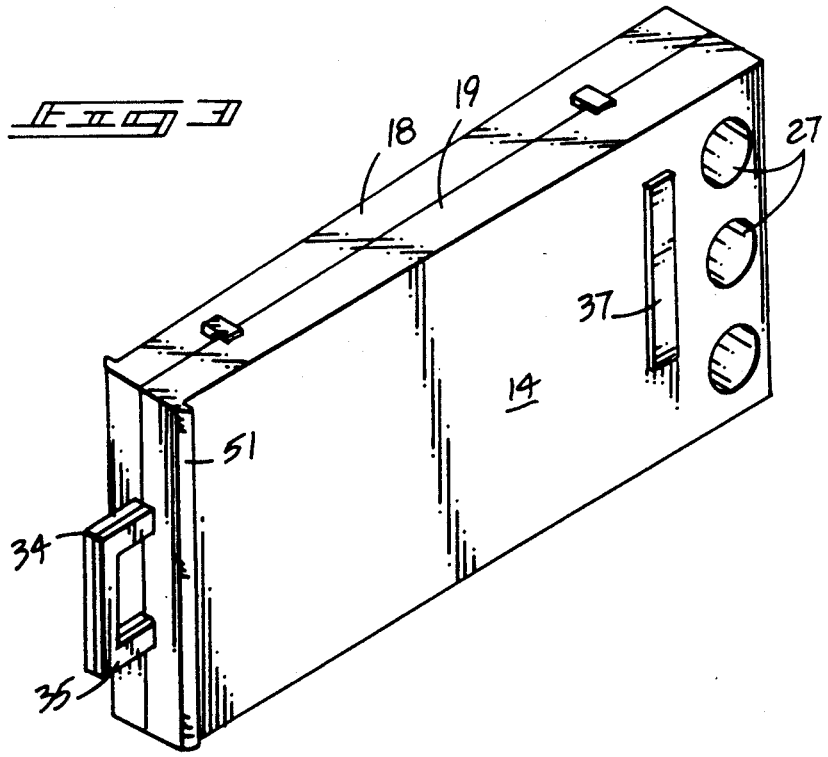
FIG. 3 is an isometric illustration of the invention in a closed configuration.
Figure 4:
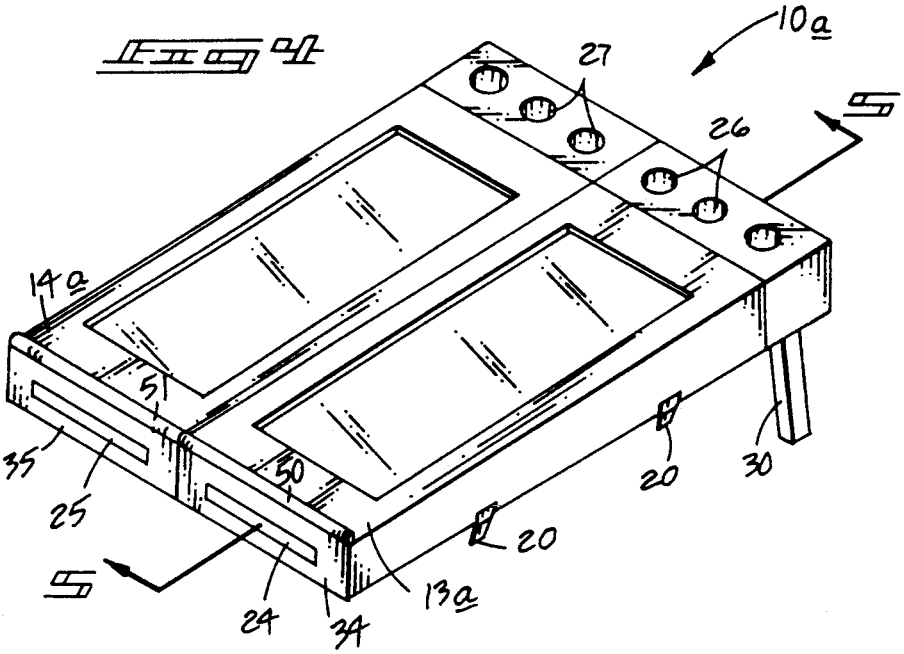
FIG. 4 is an isometric illustration of a modification of the invention.

More specifically, the bingo workstation 10 of the invention essentially comprises a first housing 11 pivotally mounted to a second housing 12. The first and second housings 11 and 12 are of a mirror image configuration. A first housing floor 13 is oriented coplanar to a second housing floor 14 when the first and second housings are in an opened first configuration, as illustrated in FIGS. 1 and 2 for example. A first housing interior side wall 15 and a second housing interior side wall 16 are hingedly mounted together utilizing a plurality of hinge members 17. It should be further noted that the hinge structure 17 permits the first and second housing units 11 and 12 to either be utilized in an organization, as set forth in FIG. 3 or as in FIG. 1, permitting the housing units to be utilized to form a single or double writing surface, as illustrated in the respective FIGS. 3 and 1. Further, the hinges are arranged utilizing a central pin axle (not shown) to permit the housing units to separate relative to one another to further permit the housing units to be utilized individually, as opposed to the combination of the side-by-side structure, as illustrated in FIG. 1 for example, to thereby permit varying in use of the organization. A first housing exterior side wall 18 is oriented parallel to the first housing interior side wall 15 in a spaced coextensive relationship with the second housing interior side wall 16 arranged parallel to a second housing exterior side wall 19. First clasp members 20 are mounted to the first housing exterior side wall for cooperation with second clasp members 21 mounted to the second housing exterior side wall 19 for securement of the first and second housings in a second confronting relationship, as illustrated in FIG. 3, orienting the first and second housings' exterior side walls 18 and 19 in a coplanar relationship, as well as the first and second housings' interior side walls 15 and 16. A first housing forward end wall 22 is orthogonally mounted to the first housings' interior and exterior walls, wherein similarly, a second housing forward end wall 23 coplanar with the first housing forward end wall 22 is orthogonally mounted between the second housing interior and exterior side walls. As illustrated in FIG. 4 for example, the first and second housings 11 and 12 include respective first and second housing cylindrical floor wells 26 and 27 for accommodating various bingo playing components, such as bingo chips, markers, and the like. These wells are positioned adjacent the forward end walls 22 and 23. A first housing rear end wall 24 and a second housing rear end wall 25 each include respective first and second handles 34 and 35 retractably mounted through the rear end walls from a first retracted position to a second extended position, as illustrated in FIG. 2, to permit transport of the organization when in a second folded configuration, as illustrated in FIG. 3. First housing rectilinear sockets 28 (see FIG. 2) are positioned in contiguous communication to the first housing floor 13 and the first housing exterior side wall 18 and interior side wall 15 contiguous to the forward end wall 22, wherein the first housing rectilinear sockets 28 each receive first leg members 30 therewithin. The first leg members 30 are complementarily received within the sockets 28 and are mounted to the housing floor 13 by utilizing first spring clips 32. Similarly, second housing rectilinear sockets 29 are fixedly and orthogonally mounted to the second housing floor 14 adjacent and in contiguous communication with the respective interior and exterior side walls 16 and 19 respectively adjacent opposed end portions of the second housing forward end wall 23 to receive respective second leg members 31, also of a complementary configuration to the second housing sockets 29. Second spring clips 33, positioned in a parallel spaced relationship relative to the second housing exterior side wall 19, normally bias and maintain the second leg member 31 in a stored configuration during transport of the organization during periods of non-use. Further, the spring clip construction 32 and 33 respectively may be mounted to the interior side walls 15 and 16 to further permit distribution of the leg members in use if required to accommodate a more evenly arranged distribution of weight within the organization. If desired, friction pads may be mounted to lower terminal ends of the first and second leg members 30 and 31 to enhance frictional engagement with the support surface when the legs are mounted within the respective sockets to provide a working surface for the coplanar first and second floors, as illustrated in FIG. 1. Further, positioned below the respective first and second floor wells 26 and 27 are respective first and second elastomeric straps 36 and 37 for securement of the bingo cards utilized in a bingo game procedure. The elastomeric straps are merely lifted and a bingo card is slid thereunder for support of the bingo cards in use. Further, the apparatus includes respective first and second abutment flanges 50 and 51 mounted coextensively to the lower surface of the floors 13 and 14 to provide an engagement surface to enhance mounting positioning of bingo card members mounted or further permit pencils, markers, and the like to be readily stored during use upon the surfaces of the floors 13 and 14.

The interior of the units 11 and 12 may be further provided with compartments 55, including first and second lids 53 and 54 hingedly mounted to overlie the compartments 55 utilizing respective first and second lift tabs 53*a* and 54*a* to permit ease of manual grasping and displacement of the lids 53 and 54. It is preferred that first and second lid hinges 56 and 57 be utilized to normally bias and maintain the lids 54 and 55 in a parallel relationship relative to the floor surfaces 14 and 13 to thereby maintain components, such as bingo chips and the like within the various compartments for storage of the components during transport of the organization and for storage of the organization during periods of non-use.

Figure 5:
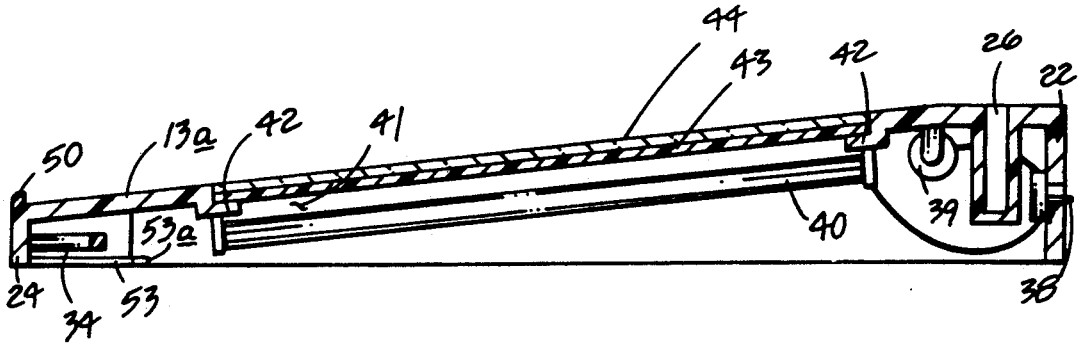
FIG. 5 is an orthographic view, taken along the lines 5—5 of FIG. 4 in the direction indicated by the arrows.

FIGS. 4 and 5 illustrate a modified workstation 10*a*, wherein modified first and second floors 13*a* and 14*a* each include a respective central floor opening 41 directed therethrough. The central floor opening includes flange supports 42, as illustrated in FIG. 5, for mounting an underlying translucent sheet 43 coextensively with a transparent sheet 44. An illumination bulb 40 operative through an on/off switch 38 and a battery 39 is provided to provide illumination through the sheets 43 and 44, wherein a bingo card is positioned between the sheets 43 and 44. The flange supports 42 are spaced below the top surface of the modified floors 13*a* and 14*a* at a predetermined spacing substantially equal to a thickness defined by the sheets 43 and 44 when mounted.

Figure 6:
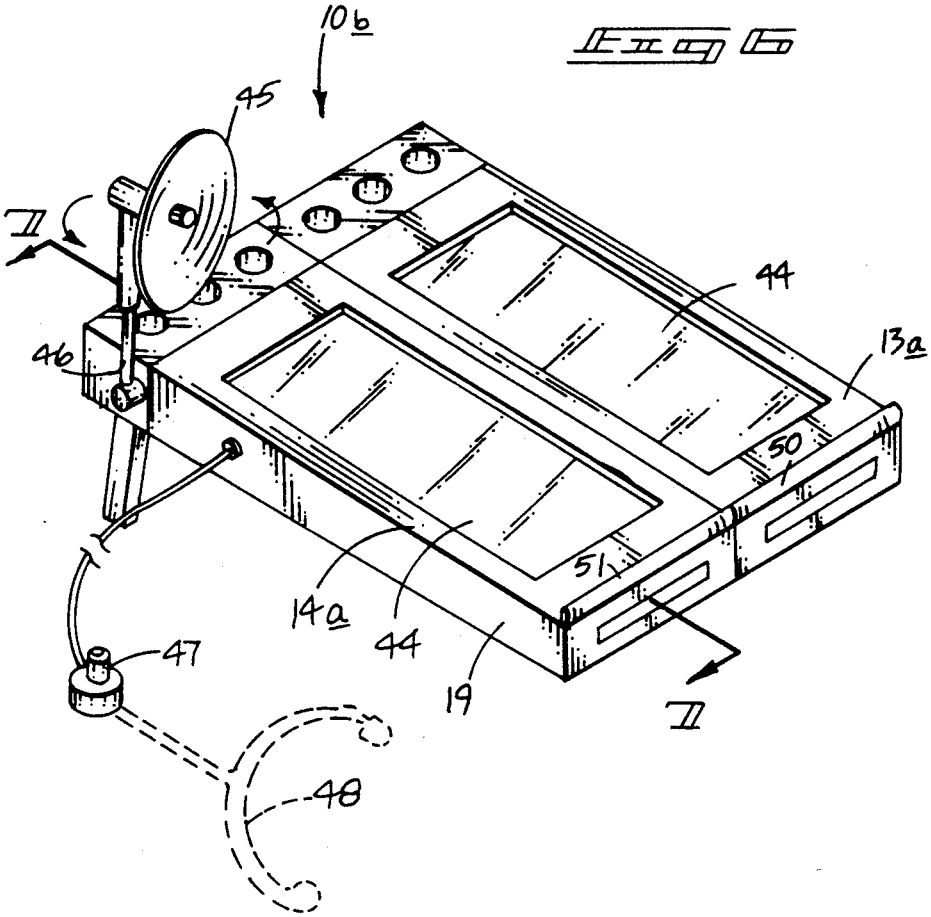
FIG. 6 is an isometric illustration of a further modification of the invention.
Figure 7:
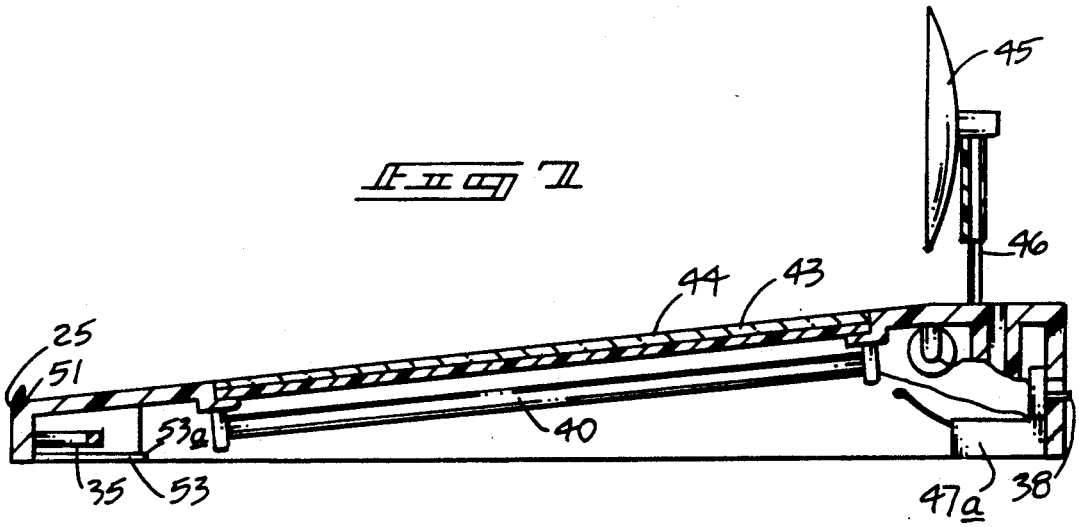
FIG. 7 is an orthographic view, taken along the lines 7—7 of FIG. 6 in the direction indicated by the arrows.

Additionally, the workstation 10*b*, as illustrated in FIG. 6 and 7, utilizes a directional audio amplification dish 45 rotatably mounted upon a support rod 46 mounted to a side wall of the organization, wherein an amplitude dial 47 is operative through an amplifier 47*a* mounted within the housing wherein an operator may utilize ear phones 48, or optionally a speaker. The dish structure 45 is utilized to enhance the ability of players to hear an announcer announcing various selected numbers in a bingo game procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows;

1. A bingo workstation, comprising, a first housing pivotally mounted to the second housing, the first and second housings are mounted in a mirror image configuration relative to one another, wherein the first housing includes a first housing floor, a first housing interior side wall, a first housing exterior side wall parallel to the first housing interior side wall and coextensive therewith, a first housing forward end wall spaced from and parallel a first housing rear end wall, the second housing includes a second housing interior side wall, a second housing exterior side wall coextensive and parallel to the second housing interior side wall, a second housing forward end wall, and a second housing rear end wall spaced from and parallel in a coextensive relationship to the second housing forward end wall, and the first housing interior side wall and the first housing exterior side wall each include at least one hinge member to hingedly mount the first housing relative to the second housing, the first housing including a first housing floor, the second housing including a second housing floor, the first housing floor coplanar with the second housing floor when the first housing and the second housing are in a first opened configuration, the first housing interior side wall, and the second housing exterior side wall are in a coplanar relationship when the first and second housings are in the second position, and the first housing rear end wall, and the second housing rear wall each include a handle means retractably mounted within each respective rear end wall, and wherein the handle means is extended relative to each end wall for transport of the first and second housing when the first and second housings are in the second position, and a plurality of first housing cylindrical floor wells orthogonally directed through the first housing floor adjacent the first housing forward end wall, and a row of spaced second housing cylindrical floor wells directed through the second housing floor adjacent the second housing forward end wall, wherein the wells are arranged for reception of bingo components therewithin, and securement means mounted to the first housing floor and the second housing floor adjacent the cylindrical floor wells for mounting of bingo cards.

2. A workstation as set forth in claim 1 wherein the securement means includes a first elastomeric strap mounted to the first housing floor to a top surface thereof, and further includes a second elastomeric strap mounted to the second housing floor to a top surface thereof adjacent the second housing cylindrical floor wells.

3. A workstation as set forth in claim 1 wherein the first housing includes a plurality of first housing sockets mounted to a bottom surface of the first housing floor, including a first housing socket of a plurality of first housing sockets mounted in contiguous communication to the first housing interior side wall and the first housing exterior side wall adjacent the first housing forward end wall, and a plurality of second housing sockets, wherein a second housing socket of a plurality of second housing sockets is mounted in contiguous communication to each second housing side wall adjacent the second housing forward end wall, and a plurality of first leg members, a first leg member mounted within each first housing socket, and a plurality of second leg members with at least one second leg member mounted within an associated second housing socket, and a plurality of first spring clips mounted to the first housing floor adjacent one of said first housing side walls for securement of the first leg members for storage thereof, and a plurality of second spring clips mounted to the second housing floor adjacent one of said second housing side walls for storage of the second leg members, wherein the first and second spring clips are arranged for securement of the respective first and second leg members when disassembled relative to the respective first and second housing sockets.

4. A workstation as set forth in claim 3 wherein the securement means includes a central floor opening directed through each of the first housing floor and the second housing floor, and each central floor opening including a plurality of flange supports, the flange supports spaced below a top surface of each floor a predetermined spacing, and a translucent sheet, and a transparent sheet mounted on the flange supports coextensively within each central floor opening defined by a predetermined thickness substantially equal to the predetermined spacing, and an illumination bulb coextensively and medially mounted below each central floor opening within each housing, including a battery and an on/off switch in association with each illumination bulb for selective illumination below each of the translucent and transparent sheets.

5. A workstation as set forth in claim 4 including a support rod mounted to the first housing, wherein the support rod rotatably mounts a directional audio amplification dish, the audio amplification dish including an ear phone set to enhance audio reception relative to the audio amplification dish.

6. A work station as set forth in claim 5 wherein the first housing floor and the second housing floor adjacent the respective first end wall and second end wall each include a plurality of compartments, with the first housing including a first lid hingedly mounted to overlie a plurality of said compartments within the first housing, and a second lid hingedly mounted to the second housing adjacent the second housing rear end wall to accommodate a further plurality of compartments of said compartments within the second housing.

* * * * *